US011718932B2

(12) United States Patent
Lai

(10) Patent No.: US 11,718,932 B2
(45) Date of Patent: Aug. 8, 2023

(54) DENIM-LIKE FABRIC

(71) Applicant: Crystal Apparel Limited, Hong Kong (CN)

(72) Inventor: Ngai Man Lai, Hong Kong (CN)

(73) Assignee: CRYSTAL APPAREL LIMITED, Hong Kong (CN)

( * ) Notice: Subject to any disclaimer, the term of this patent is extended or adjusted under 35 U.S.C. 154(b) by 134 days.

(21) Appl. No.: 17/249,935

(22) Filed: Mar. 18, 2021

(65) Prior Publication Data

US 2021/0292941 A1 Sep. 23, 2021

Related U.S. Application Data

(60) Provisional application No. 62/992,182, filed on Mar. 20, 2020.

(51) Int. Cl.
*D04B 21/18* (2006.01)
*D04B 21/16* (2006.01)

(52) U.S. Cl.
CPC ..... *D04B 21/18* (2013.01); *D04B 21/16* (2013.01)

(58) Field of Classification Search
CPC ..... D04B 21/18; D04B 21/16; D04B 23/20
See application file for complete search history.

(56) References Cited

U.S. PATENT DOCUMENTS 3,828,585 A * 8/1974 Thorneburg ..... A41B 11/00 66/182
3,952,555 A * 4/1976 Lesley ..... D04B 21/16 28/162
4,019,350 A * 4/1977 Schmidt ..... D04B 1/102 66/196
4,229,954 A * 10/1980 Blore ..... D04B 1/102 66/196
4,613,336 A * 9/1986 Quinnen ..... B65H 75/02 66/189
6,460,380 B1 * 10/2002 Sciacca ..... D04B 1/246 66/21
7,905,118 B2 * 3/2011 Regenstein ..... D04B 21/18 66/195
2002/0133865 A1 * 9/2002 Neman ..... A41B 9/08 2/170
2005/0112976 A1 * 5/2005 McMurray ..... D04B 21/18 442/306
2006/0075579 A1 * 4/2006 Shih ..... D04B 1/12 8/401
2008/0229787 A1 * 9/2008 Okamoto ..... D04B 1/243 66/171
2012/0279260 A1 * 11/2012 Dua ..... D04B 21/08 66/171
2019/0125018 A1 * 5/2019 Kurtzweg ..... B32B 7/12

* cited by examiner

*Primary Examiner* — Danny Worrell
(74) *Attorney, Agent, or Firm* — Eagle IP Limited

(57) ABSTRACT

The present invention relates to a denim-like fabric and jeans. In some embodiments, the invention relates to a denim-like knitted fabric.

27 Claims, 6 Drawing Sheets

DENIM-LIKE FABRIC

CROSS-REFERENCE TO RELATED APPLICATION

This application claims priority to, and the benefit of, U.S. Provisional Application Ser. No. 62/992,182 filed Mar. 20, 2020, entitled "A Denim-like Fabric". The entire contents of the foregoing application are hereby incorporated by reference for all purposes

FIELD OF INVENTION

The present invention relates to a denim-like fabric and jeans. In particular, the invention relates to a denim-like knitted fabric.

BACKGROUND OF INVENTION

Denim is one of the most popular fabrics worldwide used for clothing, especially jeans. Production of denim jeans is a labor-intensive process, requiring multiple steps, many of which are manual. Accordingly, there is a need for improved ways of producing denim.

SUMMARY OF INVENTION

In light of the foregoing background, it is an object of the present invention to provide a denim-like knitted fabric. The denim-like knitted fabric can be produced seamlessly with a knitting machine. Stiffness can be added to the knitted fabric to provide the feel of denim. Additionally, nylon and/or spandex yarns can be added to provide stretchability to the fabric. In some embodiments, the denim-like knitted fabric is used to make jeans.

Accordingly, the present invention provides a denim-like knitted fabric having at least one section comprising a repeating pattern, the repeating pattern comprising (1) a first course drawn into knitted loops at face and back wales, the face wales comprising cotton-like yarns and thermoplastic yarns, and the back wales comprising stretchable yarns; and (2) a second course drawn into a pattern comprising one circular knitted loop followed by two missed loops at face and back wales, wherein the face wales and the back wales comprise a predetermined combination of yarns; (3) a third course drawn into continuous circular knitted loops at face and back wales, the face wales comprising cotton-like yarns and thermoplastic yarns, and the back wales comprising stretchable yarns; and (4) a fourth course drawn into said pattern comprising one circular knitted loop followed by two missed loops at face and back wales, having alternating pattern with the second course, wherein the face wales and the back wales comprise said predetermined combination of yarns.

Other example embodiments are discussed herein.

DETAILED DESCRIPTION

Figure 1:
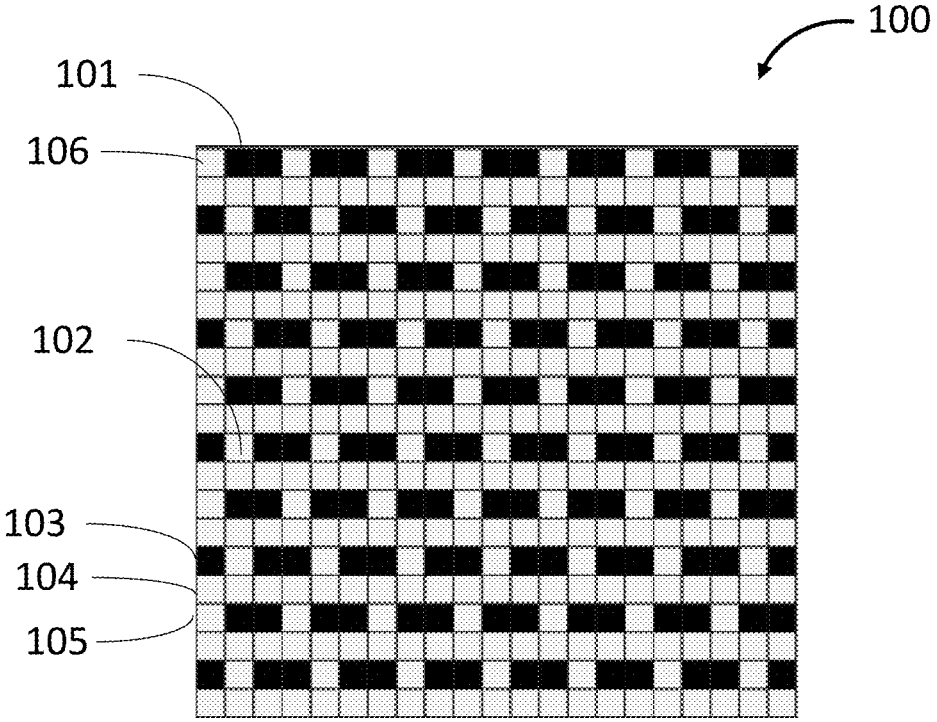
FIG. 1 shows a close-up view of the stitch pattern in accordance with an example embodiment.

As used herein and in the claims, "denim" means a hard-wearing cotton twill fabric used for jeans and other clothing.

As used herein and in the claims, "seamless" refers to smooth and continuous without seams or obvious joins on the fabric.

As used herein and in the claims, "course" means a horizontal row in the fabric.

As used herein and in the claims, "wale" means a vertical row in the fabric.

As used herein and in the claims, "face wale" means an external side of the wale in the fabric when the fabric is made into pants.

As used herein and in the claims, "back wale" means an internal side of the wale in the fabric when the fabric is made into pants.

As used herein and in the claims, "yarn" means a thread used for knitting.

As used herein and in the claims, "pocket facing" means a piece of shell material super-imposed on the top of the pocket material at its opening to conceal the lining.

One embodiment of the invention includes a denim-like knitted fabric having thermoplastic yarns, wherein said thermoplastic yarns provide stiffness to said fabric.

Some embodiments of the invention include that the denim-like knitted fabric having thermoplastic yarns are made into jeans, leisurewear, casualwear, waistband, or zip fly.

Some embodiments include the denim-like knitted fabric having thermoplastic yarns, wherein the knitted fabric is made of indigo cotton yarns, thermoplastic yarns and white nylon yarns with a twill knitting pattern, wherein the knitted fabric is made into jeans.

The embodiments of the invention include a denim-like knitted fabric having at least one section comprising a repeating pattern. In some embodiments, the repeating pattern comprises a first course drawn into continuously knitted loops at face and back wales, the face wales comprising cotton-like yarns and thermoplastic yarns, and the back wales comprising stretchable yarns. The repeating pattern also comprises a second course drawn into a pattern comprising one knitted loop followed by two missed loops at face and back wales, wherein the face wales and the back wales comprise a predetermined combination of yarns. The repeating pattern further comprises a third course drawn into continuously knitted loops at face and back wales, the face wales comprising cotton-like yarns and thermoplastic yarns, and the back wales comprising stretchable yarns. Lastly, the repeating pattern comprises a fourth course drawn into the pattern comprising one knitted loop followed by two missed loops at face and back wales, having an alternating pattern with the second course, wherein the face whales and the back wales comprise said predetermined combination of yarns.

In some embodiments, the thermoplastic yarn is a nylon thermoplastic yarn. In some embodiments, the thermoplastic yarn includes cotton yarns, nylon yarns, and spandex yarns. In some embodiments, the thermoplastic yarn is stretchable and includes spandex yarns.

In some embodiments, the predetermined combination of yarns comprises the face wales having cotton yarns and nylon yarns, and the back wales having nylon yarns and spandex yarns. In some embodiments, the face wales comprise 100% cotton yarns and 100% nylon thermoplastic yarns, and the back wales comprise 67% nylon and 33% spandex yarns for the first and the third course.

In other embodiments, the predetermined combination of yarns comprises the face wales having 100% cotton yarns, and the back wales having 100% nylon yarns. In some embodiments, the predetermined combination of yarns comprises the face wales having 100% nylon yarns, and the back wales having 67% nylon and 33% spandex yarns, wherein the denim-like knitted fabric is stretchable.

In other embodiments, the predetermined combination of yarns comprises the face wales having polyester Coolmax yarns and the back wales having nylon and spandex yarns. In some embodiments, the denim-like knitted fabric is stretchable and wicking. In other embodiments, the predetermined combination of yarns comprises the face wales having 100% polyester Coolmax yarns, and the back wales having 67% nylon and 33% spandex yarns, wherein the denim-like knitted fabric stretchable and wicking.

In some embodiments, the predetermined combination of yarns comprises the face wales having 100% polyester Coolmax yarns, and the back wales having 100% nylon yarns.

Denim has traditionally been made using a weaving technique. The techniques for making the denim-like knitted fabrics of the present invention have many advantages over current techniques for making denim. For example, the presently claimed knitting technique provides flexibility during the manufacturing process and can drastically reduce the cost of manufacturing denim jeans.

For example, the claimed knitting technique provides the ability to easily vary the number and types of yarns to be knitted into a single fabric. The process enables seamless yarn switching during the knitting process, thus reducing the overall waste of yarn.

Furthermore, the present invention provides a denim-like material that is soft, stretchable, and comfortable, while at the same time retaining sufficient stiffness in a way that mimics the feel of traditional woven denim.

Clothing, such as jeans, made from the denim-like knitted fabric of the present disclosure provides freedom of movement and comfort for the wearer. The claimed knitting technique generates loop structures in a fabric that easily distorts when the fabric is put under tension, thus creating a fabric that is stretchable. The fabric of the present disclosure further incorporates thermoplastic yarns during the knitting process that are later melted during a manufacturing process. The final knitted product therefore possesses a level of stiffness, thus retaining the feel of woven denim jeans.

In particular, by combining indigo cotton yarns, thermoplastic yarns and white nylon yarn with a twill (3×1 or 2×1) knitting pattern, a denim-like look (from the twill) and a denim-like feel (from the thermoplastic yarn) are achieved. Furthermore, nylon and or spandex yarns in courses can be added or adjusted to provide extra stretchability or knitting texture effect.

Example 1. Highly Stretchable Denim-Like Knitted Fabric

One example embodiment of the repeating pattern in a denim-like knitted fabric to make the fabric stretchable is shown in Table 1A. The repeating pattern comprises the first course having face and back wales, wherein the face wales comprise 100% cotton yarns and 100% nylon thermoplastic yarns, and the back wales comprise 67% nylon and 33% spandex yarns. The repeating pattern also comprises the second course having face and back wales, wherein the face wales comprise 100% nylon yarns and the back wales comprise 67% nylon and 33% spandex yarns. In some embodiments, this pattern can include the twill construction by introducing two missed loops followed by one knitted loop as explained above.

TABLE 1A

Yarn setup for highly stretchable denim-like knitted fabric

| Feed | | Finger | Content | Yarn | Color | Twist |
|---|---|---|---|---|---|---|
| 1 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 2 | Face | 6 | 100% Nylon | 70D/68F | White | Nil |
| | Back | 2 | 67% Nylon 33 Spandex (Cover Spandex) | 4030/12F | White | S |
| 3 | Face | 6 | 100% Cotton | 1/21s | Indigo | S |
| | Face | 6 | 100% Nylon Thermoplastic | 50D/6F | White | Nil |
| | Back | 2 | 67% Nylon 33 Spandex (Cover Spandex) | 4030/12F | White | Z |
| 4 | Face | 6 | 100% Nylon | 70D/68F | White | Nil |
| | Back | 2 | 67% Nylon 33 Spandex (Cover Spandex) | 4030/12F | White | S |
| 5 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 6 | Face | 6 | 100% Nylon | 70D/68F | White | Nil |
| | Back | 2 | 67% Nylon 33 Spandex (Cover Spandex) | 4030/12F | White | S |
| 7 | Face | 6 | 100% Cotton | 1/21s | Indigo | S |
| | Face | 6 | 100% Nylon Thermoplastic | 50D/6F | White | Nil |
| | Back | 2 | 67% Nylon 33 Spandex (Cover Spandex) | 4030/12F | White | Z |
| 8 | Face | 6 | 100% Nylon | 70D/68F | White | Nil |
| | Back | 2 | 67% Nylon 33 Spandex (Cover Spandex) | 4030/12F | White | S |

Example 2. Comfortable Denim-Like Knitted Fabric

Table 1B shows some embodiments of the repeating pattern for a denim-like knitted fabric to make the fabric less stretchable than the fabric described in Table 1A. The repeating pattern comprises the first course having face and back wales, wherein the face wales comprise 100% cotton yarns and 100% nylon thermoplastic yarns, and the back wales comprise 67% nylon and 33% spandex yarns. The repeating pattern also comprises the second course having face and back wales, wherein the face wales comprise 100% cotton yarns and the back wales comprise 100% nylon yarns. In some embodiments, this pattern can include the twill construction by introducing two missed loops followed by one knitted loop as explained above.

TABLE 1B

Yarn setup for comfortable denim-like knitted fabric

| Feed | | Finger | Content | Yarn | Color | Twist |
|---|---|---|---|---|---|---|
| 1 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 2 | Face | 6 | 100% Cotton | 1/40s | White | Z |
| | Back | 2 | 100% Nylon | 70D/68F | White | S |
| 3 | Face | 6 | 100% Cotton | 1/21s | Indigo | S |
| | Face | 6 | 100% Nylon Thermoplastic | 50D/6F | White | Nil |
| | Back | 2 | 67% Nylon 33 Spandex (Cover Spandex) | 4030/12F | White | Z |
| 4 | Face | 6 | 100% Cotton | 1/40s | White | Z |
| | Back | 2 | 100% Nylon | 70D/68F | White | S |
| 5 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 6 | Face | 6 | 100% Cotton | 1/40s | White | Z |
| | Back | 2 | 100% Nylon | 70D/68F | White | S |
| 7 | Face | 6 | 100% Cotton | 1/21s | Indigo | S |
| | Face | 6 | 100% Nylon Thermoplastic | 50D/6F | White | Nil |
| | Back | 2 | 67% Nylon 33 Spandex (Cover Spandex) | 4030/12F | White | Z |
| 8 | Face | 6 | 100% Cotton | 1/40s | White | Z |
| | Back | 2 | 100% Nylon | 70D/68F | White | S |

Example 3. Highly Stretchable Denim-Like Knitted Fabric with Wicking Function

Table 1C shows another exemplary embodiment of the repeating pattern for a denim-like knitted fabric to add the wicking function to the fabric described in Table 1A. The repeating pattern comprises the first course having face and back wales, wherein the face wales comprise 100% cotton yarns and 100% nylon thermoplastic yarns, and the back wales comprise 67% nylon and 33% spandex yarns. The repeating pattern also comprises the second course having face and back wales, wherein the face wales comprise 100% polyester Coolmax yarns and the back wales comprise 67% nylon and 33% spandex yarns. In some embodiments, this pattern can include the twill construction by introducing two missed loops followed by one knitted loop as explained above.

TABLE 1C

Yarn setup for highly stretchable denim-like knitted fabric with wicking function

| Feed | | Finger | Content | Yarn Count | Color | Twist |
|---|---|---|---|---|---|---|
| 1 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 2 | Face | 6 | 100% Polyester Coolmax (can be switched) | 70D/36F | White | Nil |
| | Back | 2 | 67% Nylon 33 Spandex (Cover Spandex) | 4030/12F | White | S |
| 3 | Face | 6 | 100% Cotton | 1/21s | Indigo | S |
| | Face | 6 | 100% Nylon Thermoplastic | 50D/6F | White | Nil |
| | Back | 2 | 67% Nylon 33 Spandex (Cover Spandex) | 4030/12F | White | Z |
| 4 | Face | 6 | 100% Polyester Coolmax (can be switched) | 70D/36F | White | Nil |
| | Back | 2 | 67% Nylon 33 Spandex (Cover Spandex) | 4030/12F | White | S |
| 5 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 6 | Face | 6 | 100% Polyester Coolmax (can be switched) | 70D/36F | White | Nil |
| | Back | 2 | 67% Nylon 33 Spandex (Cover Spandex) | 4030/12F | White | S |
| 7 | Face | 6 | 100% Cotton | 1/21s | Indigo | S |
| | Face | 6 | 100% Nylon Thermoplastic | 50D/6F | White | Nil |
| | Back | 2 | 67% Nylon 33 Spandex (Cover Spandex) | 4030/12F | White | Z |
| 8 | Face | 6 | 100% Polyester Coolmax (can be switched) | 70D/36F | White | Nil |
| | Back | 2 | 67% Nylon 33 Spandex (Cover Spandex) | 4030/12F | White | S |

Example 4. Comfortable Denim-Like Knitted Fabric with Wicking Function

Table 1D shows some exemplary embodiments of the repeating pattern for a denim-like knitted fabric to add the wicking function to the fabric described in Table 1B. The repeating pattern comprises the first course having face and back wales, wherein the face wales comprise 100% cotton yarns and 100% nylon thermoplastic yarns, and the back wales comprise 67% nylon and 33% spandex yarns. The repeating pattern also comprises the second course having face and back wales, wherein the face wales comprise 100% polyester Coolmax yarns and the back wales comprise 100% nylon yarns. In some embodiments, this pattern can include the twill construction by introducing two missed loops followed by one knitted loop as explained above.

TABLE 1D

Yarn setup for comfortable denim-like knitted fabric with wicking function

| Feed | | Finger | Content | Yarn | Color | Twist |
|---|---|---|---|---|---|---|
| 1 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 2 | Face | 6 | 100% Polyester Coolmax (can be switched) | 70D/36F | White | Z |
| | Back | 2 | 100% Nylon | 70D/68F | White | S |
| 3 | Face | 6 | 100% Cotton | 1/21s | Indigo | S |
| | Face | 6 | 100% Nylon Thermoplastic | 50D/6F | White | Nil |
| | Back | 2 | 67% Nylon 33 Spandex (Cover Spandex) | 4030/12F | White | Z |
| 4 | Face | 6 | 100% Polyester Coolmax (can be switched) | 70D/36F | White | Z |
| | Back | 2 | 100% Nylon | 70D/68F | White | S |
| 5 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 6 | Face | 6 | 100% Polyester Coolmax (can be switched) | 70D/36F | White | Z |
| | Back | 2 | 100% Nylon | 70D/68F | White | S |
| 7 | Face | 6 | 100% Cotton | 1/21s | Indigo | S |
| | Face | 6 | 100% Nylon Thermoplastic | 50D/6F | White | Nil |
| | Back | 2 | 67% Nylon 33 Spandex (Cover Spandex) | 4030/12F | White | Z |
| 8 | Face | 6 | 100% Polyester Coolmax (can be switched) | 70D/36F | White | Z |
| | Back | 2 | 100% Nylon | 70D/68F | White | S |

In some embodiments, the 100% cotton yarns include indigo dyeing such that the fabric has a blue color. In some embodiments, the blue color looks like the color of blue jeans. In other embodiments, the indigo dyeing can be done with sulfur color dyeing or another reactive color dyeing. In some embodiments, instead of the 100% indigo cotton, heather grey yarns, cotton/polyester (T/C) blend yarns, cotton/rayon blend yarns, cotton/Tencel blend yarns or cotton/hemp blend yarns can be used for the fabric.

In some embodiments, the 67% nylon and 33% spandex yarns are covered spandex with nylon wrapping the spandex. In other exemplary embodiments, the 67% nylon and 33% spandex can be replaced with bare lycra yarns, T400 yarns, or any stretchable yarns.

In some embodiments, the polyester Coolmax can be replaced with any other synthetic functional yarns.

In some embodiments, the repeating pattern for the denim-like knitted fabric has 3×1 or 2×1 twill pattern. In some embodiments, the denim-like knitted fabric is made into jeans.

FIG. 1 shows a stitch pattern in accordance with an example embodiment. In particular, the pattern is to simulate the construction of the real woven 3×1 twill to make the fabric look like denim. Each small box 106 represents a loop made from the knitting machine. The grey-colored loop 106 means that the loop is knitted and the black-colored loop 101 means that the loop is missed for the purpose of making the twill. In this pattern, two missed loops are followed by one knitted loop in a single course 103. In the following course 104, all loops are knitted continuously. In the next course 105, the repeating pattern is that two missed loops are followed by one knitted loop, and this pattern is alternating with the pattern in course 103.

The embodiments of the invention also include a denim-like knitted fabric for a waistband having at least one section comprising a repeating pattern. In some embodiments, the repeating pattern comprises a first course drawn into continuously knitted loops at face and back wales, wherein the face wales comprise cotton yarns and thermoplastic yarns, and the back wales comprise stretchable yarns. The repeating pattern also comprises a second course drawn into a pattern comprising one knitted loop followed by two missed loops at face and back wales, wherein the face wales and the back wales comprise a predetermined combination of yarns. The repeating pattern further comprises a third course drawn into continuously knitted loops at face and back wales, wherein the face wales comprise cotton yarns and the back wales comprise stretchable yarns. Lastly, the repeating pattern comprises a fourth course drawn into a pattern comprising one knitted loop followed by two missed loops at face and back wales, having an alternating pattern with the second course, wherein the face wales and the back wales comprise said predetermined combination yarn.

In some embodiments, the fabric for the waistband is selected from the group consisting of cotton yarn, nylon yarn, thermoplastic yarn, and stretchable yarn. In some embodiments, the stretchable yarn is spandex. In other embodiments, the thermoplastic yarn is nylon thermoplastic yarn.

In some embodiments, the face wales comprise cotton yarns and thermoplastic yarns, and the back wales comprise stretchable yarns. In some embodiments, the back wales comprise stretchable yarns for the third course. In other embodiments, the face wales comprise 100% cotton yarns and 100% nylon thermoplastic yarns, and the back wales comprise 67% nylon and 33% spandex yarns for the first course and the third course. In other embodiments, the face wales comprise 100% nylon yarns and the back wales comprise 67% nylon and 33% spandex yarns for the second and the fourth course.

In some embodiments, the face wales comprise 100% cotton yarns and 100% nylon thermoplastic yarns, and the back wales comprise 67% nylon and 33% spandex yarns for the first course, wherein the face wales comprise 100% cotton yarns and the back wales comprise 67% nylon and 33% spandex yarns for the third course. In other embodiments, the predetermined combination of yarns comprises the face wales having 100% nylon yarns and the back wales having 67% nylon and 33% spandex.

Example 1. Button Opening Denim-Like Knitted Waistband

One exemplary embodiment of the repeating pattern in a denim-like knitted waistband with the button opening design is shown in Table 2A. The repeating pattern comprises a first course having face and back wales, wherein the face wales comprise 100% cotton yarns and 100% nylon thermoplastic yarns, and the back wales comprise 67% nylon and 33% spandex yarns. The repeating pattern also comprises a second course having face and back wales, wherein the face wales comprise 100% nylon yarns and the back wales comprise 67% nylon and 33% spandex yarns. The repeating pattern also comprises a third course having face and back wales, wherein the face wales comprise 100% cotton yarns and the back wales comprise 67% nylon spandex yarns. Lastly, the repeating pattern comprises a fourth course having face and back wales, wherein the face wales comprise 100% nylon yarns and the back wales comprise 67% nylon and 33% spandex yarns. In some embodiments, this pattern can include the twill construction by introducing two missed loops followed by one knitted loop as explained above.

TABLE 2A

Yarn setup for button opening denim-like knitted waistband

| Feed | | Finger | Content | Yarn | Color | Twist |
|---|---|---|---|---|---|---|
| 1 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 2 | Face | 6 | 100% Nylon | 70D/68F | White | Nil |
| | Back | 2 | 67% Nylon 33 Spandex (Cover Spandex) | 4030/12F | White | S |
| 3 | Face | 6 | 100% Cotton | 1/21s | Indigo | S |
| | Back | 2 | 67% Nylon 33 Spandex (Cover Spandex) | 4030/12F | White | Z |
| 4 | Face | 6 | 100% Nylon | 70D/68F | White | Nil |
| | Back | 2 | 67% Nylon 33 Spandex (Cover Spandex) | 4030/12F | White | S |
| 5 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 6 | Face | 6 | 100% Nylon | 70D/68F | White | Nil |
| | Back | 2 | 67% Nylon 33 Spandex (Cover Spandex) | 4030/12F | White | S |
| 7 | Face | 6 | 100% Cotton | 1/21s | Indigo | S |
| | Back | 2 | 67% Nylon 33 Spandex (Cover Spandex) | 4030/12F | White | Z |
| 8 | Face | 6 | 100% Nylon | 70D/68F | White | Nil |
| | Back | 2 | 67% Nylon 33 Spandex (Cover Spandex) | 4030/12F | White | S |

Figure 2A:
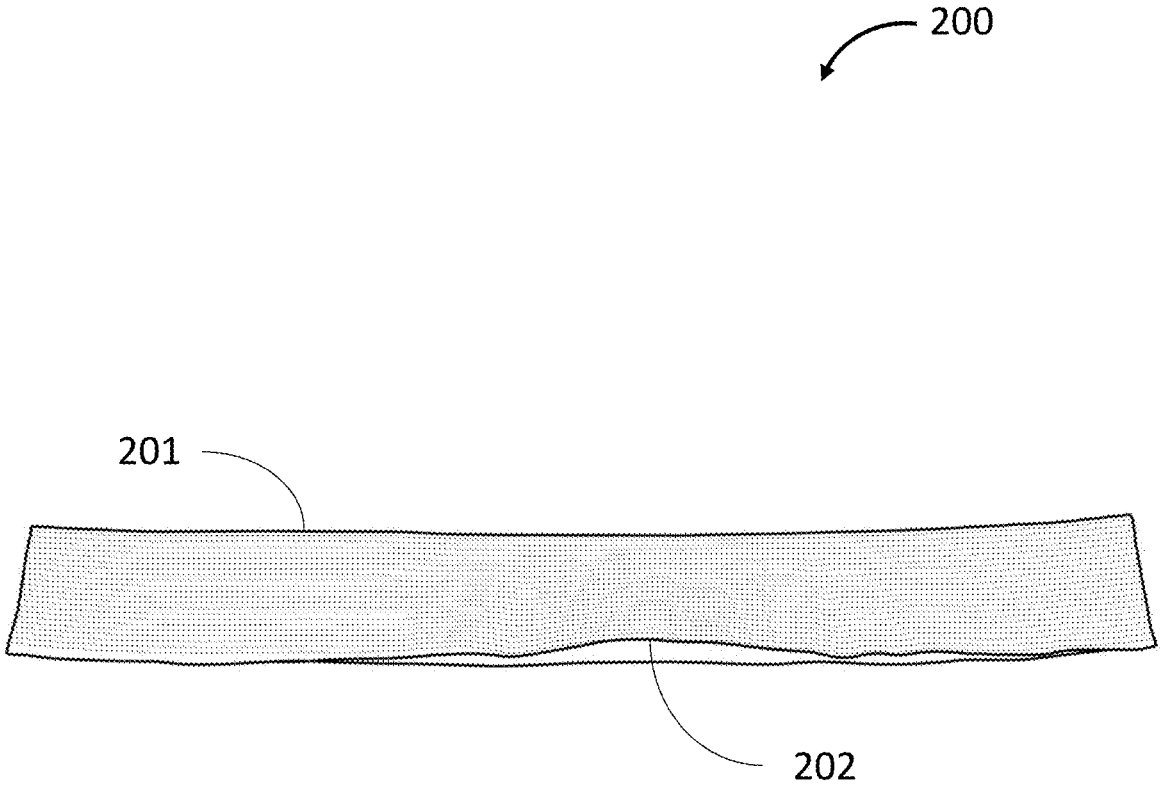
FIG. 2A shows a front view of five-pocket pants where the waistband is knitted with thermoplastic yarns in accordance with an example embodiment.
Figures 2B, 2C:
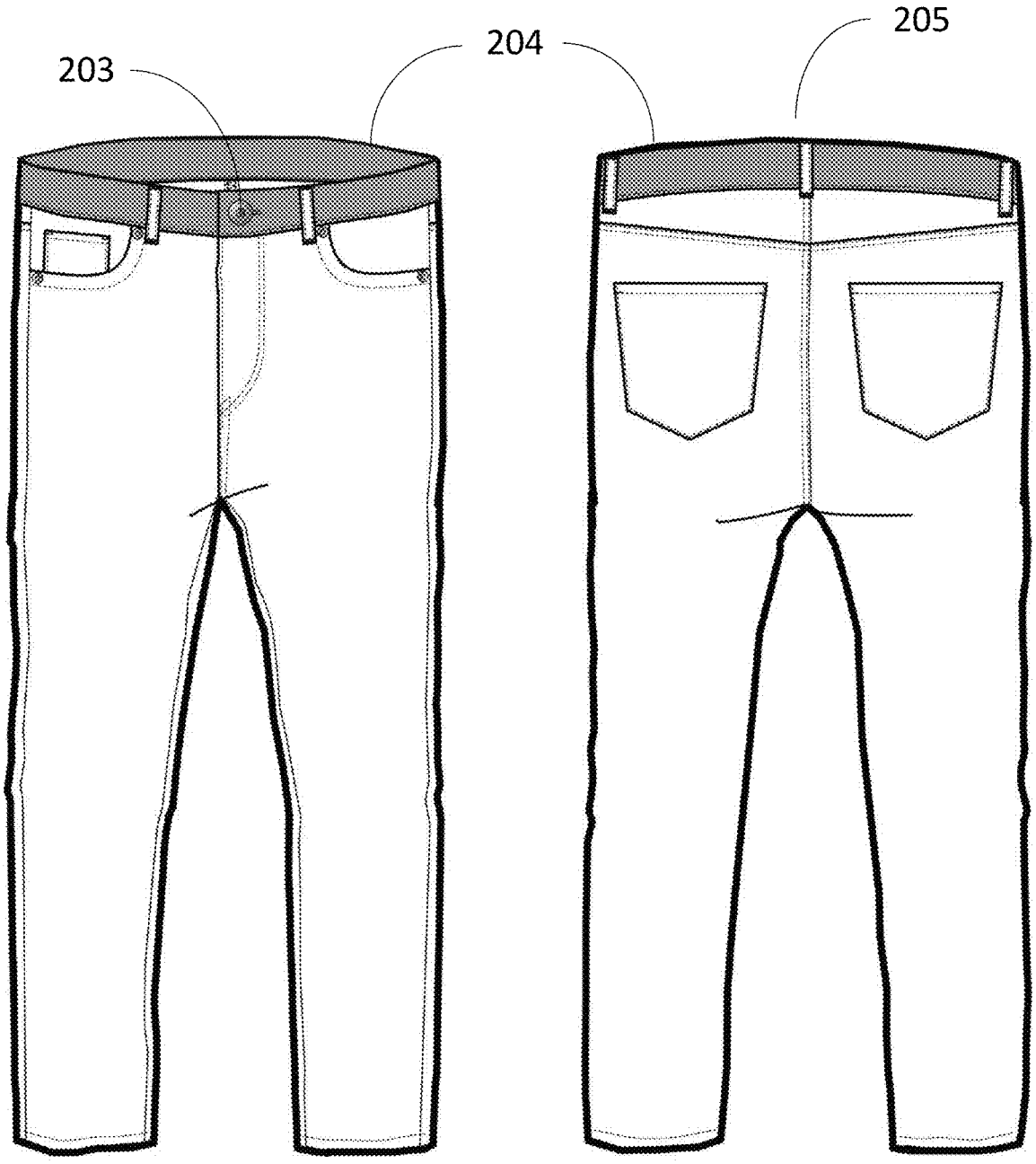
FIG. 2B shows a front view of five-pocket pants where the waistband is knitted with thermoplastic yarns in accordance with an example embodiment.
FIG. 2C shows a rear view of five-pocket pants where the waistband is knitted with thermoplastic yarns in accordance with an example embodiment.

FIGS. 2A-C show five-pocket pants 205 where the waistband 200 is knitted with thermoplastic yarns in accordance with an example embodiment. All knitted fabric will curl on the edge as shown in 202. With the curled edge, it is difficult to use the conventional method of sewing the waistband to the bodice in mass production because the curled edge cannot be fitted into the waistband. However, with thermoplastic yarn knitted in the waistband, the edge will not be curled as shown in 201. FIGS. 2B and 2C show one example embodiment of the waistband 204 installed on the five-pocket pants 205 with a button opening 203. The waistband contains thermoplastic yarns knitted in every four courses in the fabric as shown in Table 2A.

Example 2. Seamless Denim-Like Knitted Waistband

Other exemplary embodiments of the repeating pattern in a denim-like knitted waistband with the seamless design are shown in Table 2B. The repeating pattern comprises a first course having face and back wales, wherein the face wales comprise 100% cotton yarns and 100% nylon thermoplastic yarns, and the back wales comprise 67% nylon and 33% spandex yarns. The repeating pattern also comprises a second course having face and back wales, wherein the face wales comprise 100% nylon yarns and the back wales comprise 67% nylon and 33% spandex yarns. The repeating pattern further comprises a third course having face and back wales, wherein the face wales comprise 100% cotton yarns and 100% nylon thermoplastic yarns, and the back wales comprise 67% nylon and 33% spandex yarns. Lastly, the repeating pattern comprises a fourth course having face and back wales, wherein the face wales comprise 100% nylon yarns and the back wales comprise 67% nylon and 33% spandex yarns. In some embodiments, this pattern can include the twill construction by introducing two missed loops followed by one knitted loop as explained above.

TABLE 2B

Yarn setup for seamless denim-like knitted waistband

| Feed | | Finger | Content | Yarn | Color | Twist |
|---|---|---|---|---|---|---|
| 1 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 2 | Face | 6 | 100% Nylon | 70D/68F | White | Nil |
| | Back | 2 | 67% Nylon 33 Spandex (Cover Spandex) | 4030/12F | White | S |
| 3 | Face | 6 | 100% Cotton | 1/21s | Indigo | S |
| | Face | 6 | 100% Nylon Thermoplastic | 50D/6F | White | Nil |
| | Back | 2 | 67% Nylon 33 Spandex (Cover Spandex) | 4030/12F | White | Z |
| 4 | Face | 6 | 100% Nylon | 70D/68F | White | Nil |
| | Back | 2 | 67% Nylon 33 Spandex (Cover Spandex) | 4030/12F | White | S |
| 5 | Face | 6 | 100% Cotton | 1/21s | Indigo | Z |
| | Face | 6 | 100% Nylon Thermoplastic | 50D/6F | White | Nil |
| | Back | 2 | 67% Nylon 33 Spandex (Cover Spandex) | 4030/12F | White | Z |
| 6 | Face | 6 | 100% Nylon | 70D/68F | White | Nil |
| | Back | 2 | 67% Nylon 33 Spandex (Cover Spandex) | 4030/12F | White | S |
| 7 | Face | 6 | 100% Cotton | 1/21s | Indigo | S |
| | Face | 6 | 100% Nylon Thermoplastic | 50D/6F | White | Nil |
| | Back | 2 | 67% Nylon 33 Spandex (Cover Spandex) | 4030/12F | White | Z |
| 8 | Face | 6 | 100% Nylon | 70D/68F | White | Nil |
| | Back | 2 | 67% Nylon 33 Spandex (Cover Spandex) | 4030/12F | White | S |

Figures 3A, 3B:
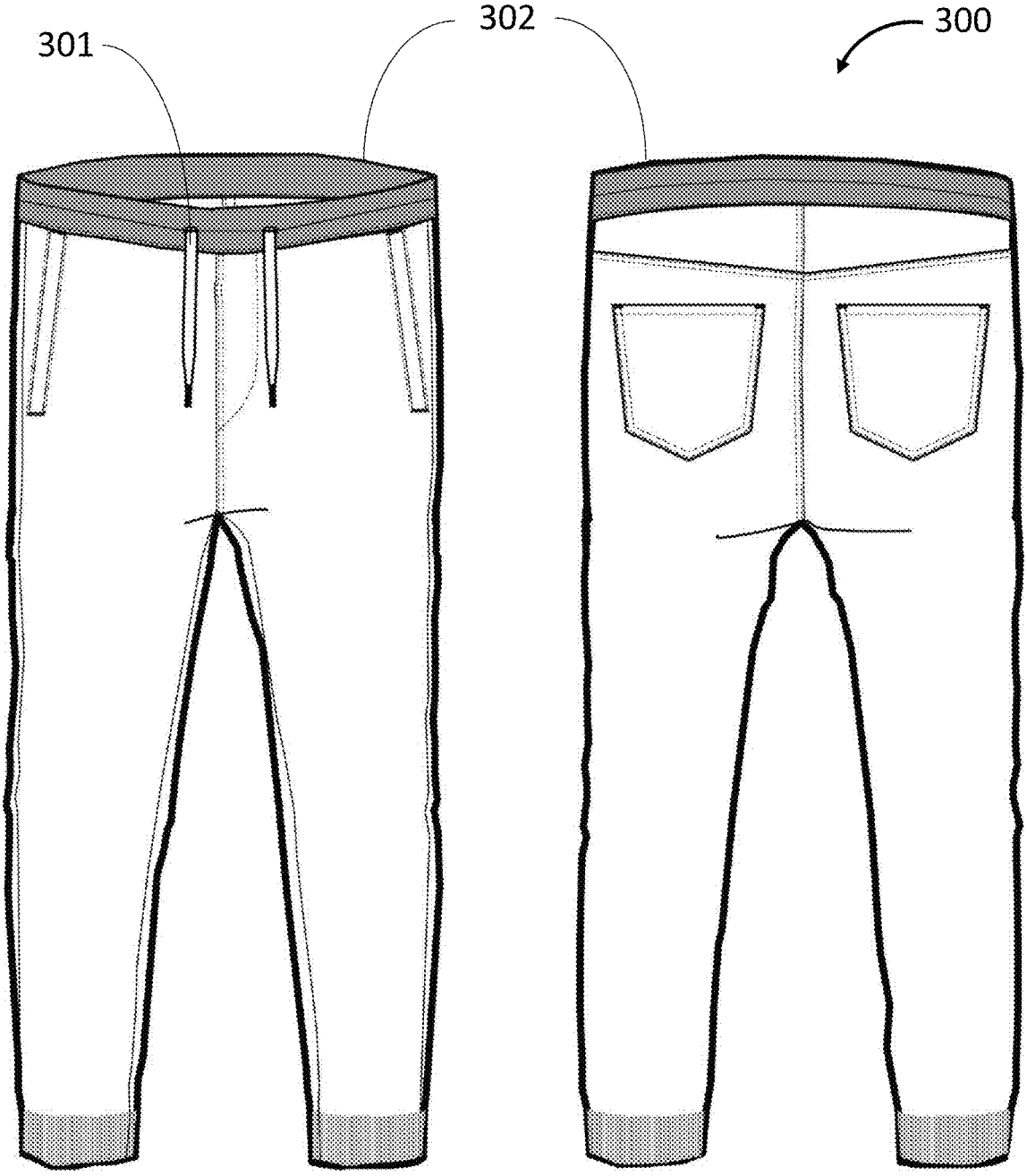
FIG. 3A shows a front view of jogger pants where the waistband is knitted seamlessly with thermoplastic yarns in accordance with an example embodiment.
FIG. 3B shows a rear view of jogger pants where the waistband is knitted seamlessly with thermoplastic yarns in accordance with an example embodiment.

FIGS. 3A and 3B show one example of embodiments of the waistband 302 installed on the jogger pants 300. The small hole 301 can be added to the waistband in order to give more functions. The waistband 302 contains thermoplastic yarns knitted in every two courses in the fabric.

In some embodiments, the repeating pattern for the waistband has 3×1 or 2×1 twill pattern.

One embodiment of the invention includes a method of making denim-like knitted pants (i.e., jeans) with at least one seamless pocket. In some embodiments, the method comprises knitting a pocket facing with yarns for a pocket facing using a knitting machine, switching the yarns for the pocket facing to yarns for a pocket bag in the same knitting machine, and knitting, in the same knitting machine, the pocket bag with the yarns for the pocket bag. In some embodiments, the pocket facing and the pocket bag are integrated seamlessly and knitted into one single tube. In some embodiments, the yarns for the pocket facing are indigo yarns and the yarns for the pocket bag are white yarns, whereby a thinner white mesh construction is formed in the pocket bag and integrated seamlessly with the pocket facing.

Figure 4:
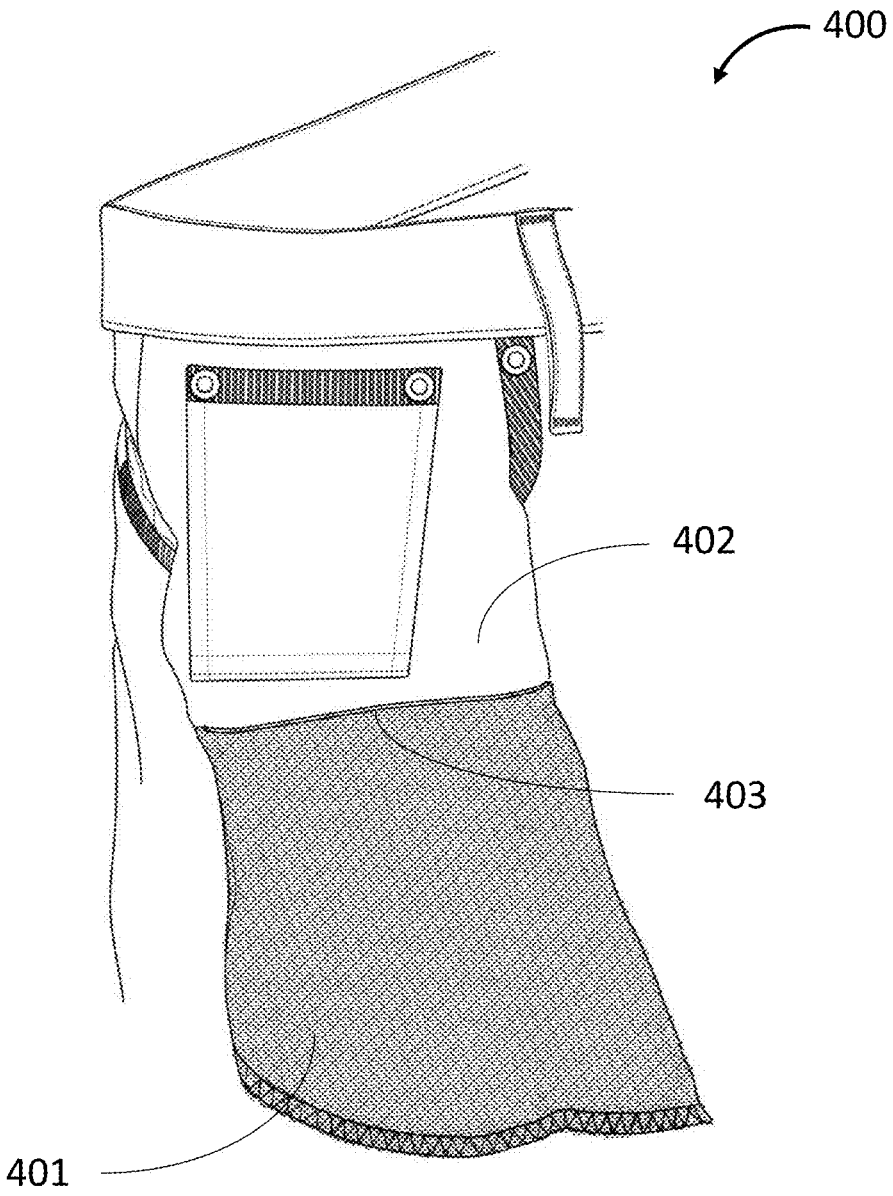
FIG. 4 shows a close-up view of a pocket where a pocket facing and a pocket bag are integrated seamlessly in accordance with an example embodiment.

FIG. 4 shows an inside of the pocket 400 where a pocket facing 401 and a pocket bag 402 are integrated seamlessly in accordance with an example embodiment. By switching yarns for the pocket facing to yarns for the pocket bag in the same knitting machine, the boundary 403 between the pocket facing and the pocket bag can be produced seamlessly.

Another embodiment provides a denim-like knitted jean comprising the denim-like knitted fabric of claim 1 and at least one seamless pocket. In some embodiments, the seamless pocket comprises a pocket bag, wherein the pocket bag comprises a mesh fabric that is thinner and softer compared with the denim-like knitted fabric of the jean.

Figure 5:
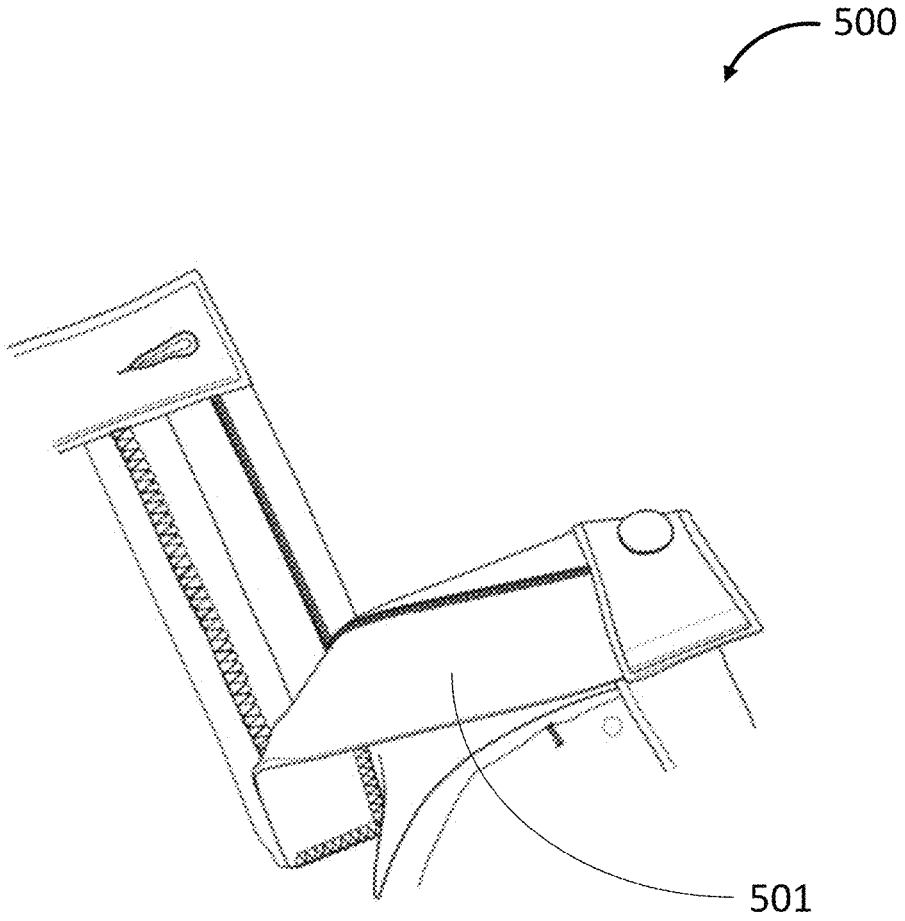
FIG. 5 shows a close-up view of a zip fly and catch with thermoplastic yarns in accordance with an example embodiment.

Some embodiments of the invention also include a denim-like knitted zip fly and catch, wherein said knitted zip fly and catch are fused with thermoplastic yarns. In some embodiments, said knitted zip-fly and catch are made using the denim-like knitted fabric of the present disclosure. FIG. 5 shows a zip fly and catch system 500 with thermoplastic yarns in accordance with an example embodiment. By integrating thermoplastic yarns in the zip fly 501, the curled edge can be prevented.

The exemplary embodiments of the present invention are thus fully described. Although the description referred to particular embodiments, it will be clear to one skilled in the art that the present invention may be practiced with a variation of these specific details. Hence this invention should not be construed as limited to the embodiments set forth herein.

What is claimed is:

1. A denim-like knitted fabric comprising thermoplastic yarns, wherein said thermoplastic yarns provide stiffness to said fabric, wherein the knitted fabric is made of indigo cotton yarns, thermoplastic yarns and white nylon yarns with a twill knitting pattern, wherein the denim-like knitted fabric further comprises face and back wales; and the twill knitting pattern comprises a repeating pattern, the repeating pattern comprising:

a first course drawn into knitted loops at the face and back wales, the face wales comprising cotton-like yarns and thermoplastic yarns, and the back wales comprising stretchable yarns;

a second course drawn into a pattern comprising one knitted loop followed by two missed loops at the face and back wales, wherein the face wales and the back wales comprise a predetermined combination of yarns;

a third course drawn into knitted loops at the face and back wales, the face wales comprising cotton-like yarns and thermoplastic yarns, and the back wales comprising stretchable yarns; and a fourth course drawn into said pattern comprising one knitted loop followed by two missed loops at the face and back wales, wherein the fourth course has an alternating pattern with the second course, and wherein the face wales and the back wales comprise said predetermined combination of yarns.

2. The denim-like knitted fabric of claim 1, wherein the denim-like knitted fabric is made into jeans, leisurewear, casualwear, a waistband, or a zip fly.

3. The denim-like knitted fabric of claim 1, wherein the repeating pattern has 3×1 or 2×1 twill pattern.

4. The denim-like knitted fabric of claim 1, wherein the cotton-like yarn is selected from the group consisting of heather grey yarns, cotton/polyester (T/C) blend yarns, cotton/rayon blend yarns, cotton/Tencel blend yarns and cotton/hemp blend yarns.

5. The denim-like knitted fabric of claim 1, wherein the stretchable yarn is selected from the group consisting of bare lycra yarns, T400 yarns and any stretchable yarns.

6. The denim-like knitted fabric of claim 1, wherein the thermoplastic yarn is nylon thermoplastic yarn.

7. The denim-like knitted fabric of claim 1, wherein the face wales comprise 100% cotton yarns and 100% nylon thermoplastic yarns, and the back wales comprise 67% nylon and 33% spandex yarns for the first course and the third course.

8. The denim-like knitted fabric of claim 1, wherein the predetermined combination of yarns comprises the face wales having 100% nylon yarns, and the back wales having 67% nylon and 33% spandex yarns, wherein the denim-like fabric is stretchable.

9. The denim-like knitted fabric of claim 1, wherein the predetermined combination of yarns comprises the face wales having 100% cotton yarns, and the back wales having 100% nylon yarns, wherein the denim-like fabric is less stretchable than the denim-like fabric of claim 1 wherein the predetermined combination of yearns comprises the face wales having 100% nylon yarns, and the back wales having 67% nylon and 33% spandex yarns, wherein the denim-like fabric is stretchable.

10. The denim-like knitted fabric of claim 1, wherein the predetermined combination of yarns comprises the face wales having 100% polyester Coolmax yarns, and the back wales having 67% nylon and 33% spandex yarns, wherein the denim-like fabric is wicking and stretchable.

11. The denim-like knitted fabric of claim 1, wherein the predetermined combination of yarns comprises the face wales having 100% polyester Coolmax yarns, and the back wales having 100% nylon yarns, wherein the denim-like fabric is wicking and less stretchable than the denim-like fabric of claim 1 wherein the predetermined combination of yarns comprises the face wales having 100% polyester Coolmax yarns, and the back wales having 67% nylon and 33% spandex yarns, wherein the denim-like fabric is wicking and stretchable.

12. The denim-like knitted fabric of claim 1, wherein the denim-like fabric is made into jeans.

13. A denim-like knitted fabric for waistband having face and back wales, wherein at least one section of the waistband knitted fabric comprises a repeating pattern, the repeating pattern comprising:

a first course drawn into knitted loops at the face and the back wales, wherein the face wales comprise cotton yarns and thermoplastic yarns, and the back wales comprise stretchable yarns;

a second course drawn into a pattern comprising one knitted loop followed by two missed loops at the face and the back wales, wherein the face wales and the back wales comprise a predetermined combination of yarns;

a third course drawn into knitted loops at the face and the back wales, the face wales comprise cotton yarns and the back wales comprise stretchable yarns; and a fourth course drawn into said pattern comprising one knitted loop followed by two missed loops at face and back wales, wherein said fourth course has an alternating pattern with the second course, and wherein the face wales and the back wales comprise said predetermined combination of yarns.

14. The denim-like knitted fabric of claim 13, wherein the repeating pattern has 3×1 or 2×1 twill pattern.

15. The denim-like knitted fabric of claim 13, wherein the fabric is selected from the group consisting of cotton yarn, nylon yarn, thermoplastic yarn, and stretchable yarn.

16. The denim-like knitted fabric of claim 15, wherein the stretchable yarn is spandex.

17. The denim-like knitted fabric of claim 15, wherein the thermoplastic yarn is nylon thermoplastic yarn.

18. The denim-like knitted fabric of claim 13, wherein the face wales comprise cotton yarns and thermoplastic yarns, and the back wales comprise stretchable yarns for the third course.

19. The denim-like knitted fabric of claim 13, wherein the face wales comprise 100% nylon yarns and the back wales comprise 67% nylon and 33% spandex yarns for the second course and the fourth course.

20. The denim-like knitted fabric of claim 13, wherein the face wales comprise 100% cotton yarns and 100% nylon thermoplastic yarns, and the back wales having 67% nylon and 33% spandex yarns for the first course, and wherein the face wales comprise 100% cotton yarns and the back wales comprise 67% nylon and 33% spandex yarns for the third course.

21. The denim-like knitted fabric of claim 18, wherein the face wales comprise 100% cotton yarns and 100% nylon thermoplastic yarns, and the back wales comprise 67% nylon and 33% spandex yarns for the first course and the third course.

22. The denim-like knitted fabric of claim 13, wherein the predetermined combination of yarns comprises the face wales having 100% nylon yarns and the back wales having 67% nylon and 33% spandex yarns.

23. A method of making denim-like knitted pants with at least one seamless pocket, comprising:

knitting a pocket facing with yarns for the pocket facing using a knitting machine; switching the yarns for the pocket facing to yarns for a pocket bag in the same knitting machine; and knitting, in the same knitting machine, the pocket bag with the yarns for the pocket bag;

whereby the pocket facing and the pocket bag are integrated seamlessly and knitted into one single tube, wherein the denim-like knitted pants comprise the denim-like knitted fabric of claim 1.

24. The method of claim 23, wherein the yarns for the pocket facing is indigo yarns and the yarns for the pocket bag is white yarns, whereby a thinner white mesh construction is formed in the pocket bag and integrated seamlessly with the pocket facing.

25. A denim-like knitted jean comprising the denim-like knitted fabric of claim 1 and at least one seamless pocket.

26. The denim-like knitted jean according to claim 25, wherein the seamless pocket comprises a pocket bag, wherein the pocket bag comprises a mesh fabric that is thinner and softer compared with the denim-like knitted fabric of the jean.

27. A knitted zip-fly and catch, wherein said knitted zip-fly and catch are made using the denim-like knitted fabric of claim 1.

* * * * *